US006170415B1

(12) United States Patent
Inoue et al.

(10) Patent No.: US 6,170,415 B1
(45) Date of Patent: Jan. 9, 2001

(54) SEWING MACHINE WITH MULTIPLE NEEDLES

(75) Inventors: Kazushi Inoue, Aichi-ken; Hitomi Ori, Okazaki; Motonari Nakano, Ichinomiya; Yoshihisa Nozaki, Aichi-ken, all of (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/409,691

(22) Filed: Sep. 30, 1999

(30) Foreign Application Priority Data

Nov. 17, 1998 (JP) ..... 10-327118

(51) Int. Cl.[7] ..... D05B 55/16
(52) U.S. Cl. ..... 112/163
(58) Field of Search ..... 112/163, 167, 112/168

(56) References Cited

U.S. PATENT DOCUMENTS 4,473,018 * 9/1984 Shimoda et al. ..... 112/163
4,531,467 * 7/1985 Golia, Jr. et al. ..... 112/163 X
4,719,865 * 1/1988 Yokoe et al. ..... 112/163
5,957,069 * 9/1999 Shibata ..... 112/163 X

FOREIGN PATENT DOCUMENTS 61-37194 2/1986 (JP) .
9-38367 2/1997 (JP) .
9-75569 3/1997 (JP) .

* cited by examiner

*Primary Examiner*—Ismael Izaguirre
(74) *Attorney, Agent, or Firm*—Oliff & Berridge, PLC

(57) ABSTRACT

A sewing machine with multiple needles employs, for each needle, a needle bar guide in the shape of the letter "c" and cooperates with a projection. The needle bar guide holds a needle bar by passing the needle bar through holes formed at upper and lower positions of the needle bar guide. Therefore, when the projection is rotated in a boss, the needle bar guide is also rotated, and the end of the needle is oscillated. When the projection is moved back and forth in the boss, the end of the needle is also moved in the same manner. Consequently, a deviation in the relative position between a needle and a rotary hook caused by a slight difference in machining and assembly accuracy can be adjusted for every needle.

18 Claims, 6 Drawing Sheets

SEWING MACHINE WITH MULTIPLE NEEDLES

BACKGROUND OF THE INVENTION

1. Field of Invention

The invention relates to a sewing machine having multiple needle bars and needle thread take-ups which are used in a sequential manner enabling creation of a sewing pattern in which multiple colors are used.

2. Description of Related Art

Conventionally, there are sewing machines having a plurality of needle bars and needle thread take-ups on a machine head, which are changed one by one successively to continue a sewing operation. These examples are indicated in Japanese laid-open Patent Publication Nos. 9-38367 and 9-75569.

When one such sewing machine is used for creating a colorful sewing pattern stitched with various color threads, it can continue a sewing operation while automatically changing needles without interruption so that operator does not have to change threads.

However, speeding up of the sewing machine has been recently tried to produce sewing operations with high efficiency. For an embroidery machine, for example, the speed of the upper shaft is limited to about 1,000 to 1,200 rpm, but it is expected to be higher.

Where multiple needle bars are installed in a sewing machine, all needle positions are not aligned because of slight differences, such as machining accuracy and assembly accuracy. As a result, a relative position between a needle attached to the bottom of a needle bar and a rotary hook often varies for each needle. Therefore stitching quality deteriorates when the machine is in operation at a higher speed.

SUMMARY OF THE INVENTION

The invention was made in view of such problems, and it is therefore an object of the invention to provide a sewing machine with multiple needles that can maintain sewing quality during high speed sewing by enabling the adjustment of the needles individually to eliminate variations therebetween.

To accomplish the object, the invention provides a sewing machine with multiple needles having a plurality of needle bars that are arranged in a horizontal line, a box holding the needle bars, a needle bar driving part that allows each needle bar to move up and down, a body frame including the needle bar driving parts, and a box driving part that moves the box right and left relative to the body frame, to transmit the driving force of a needle bar driving part only to a desired needle bar, and a needle position adjusting part provided in each needle bar, wherein a relative position between a needle that is attached to the bottom of the needle bar and a rotary hook that receives both the needle and an upper thread put through the needle can be adjusted.

In the sewing machine with multiple needles, a relative position between a needle attached to the end of the needle bar and a rotary hook can be adjusted for each needle bar.

Therefore, according to the sewing machine with multiple needles, the position of an individual needle varies from that of other needle bars because of variations in machining and assembly accuracy, but it can be adjusted using the needle position adjusting part. Moreover, the position of the needle can be adjusted for each needle bar without affecting the remaining needle bars. Accordingly, sewing quality can be assured even during high-speed sewing.

In a preferred form of the invention, the needle position adjusting parts are provided at the box so that they can be individually adjusted right and left. They correspond to needle bar guides that hold each needle bar vertically.

Therefore, according to the sewing machine with multiple needles, the positional deviation between a needle and the rotary hook, which occurs in the right and left direction, can be adjusted for each needle.

In another preferred form of the invention, the needle position adjusting parts are provided at the box so that they can be individually adjusted back and forth. They correspond to needle bar guides that hold each needle bar vertically. Therefore, according to the sewing machine with multiple needles, the positional deviation between a needle and rotary hook can be adjusted on each needle in the back and forth direction.

In a further preferred form of the invention, the needle bar guide, in the shape of the letter "c", holds the needle bar vertically by passing it through upper and lower holes of the needle bar guide, and comprises a projection provided horizontally in the opposite direction to the side through which the needle bar passes. The box has a hole to be engaged with the projection. The projection and the hole are used to adjust the relative position between the needle and the rotary hook. By adjusting the amount and angle of how much the projection is fit into the hole, the relative position between the needle and the rotary hook can be adjusted.

In the sewing machine with multiple needles as arranged above, the needle bar guide can be moved back and forth for adjustment by changing the amount and angle of how much the projection is fit into the hole. The tip of the needle bar can be moved right or left by turning the projection in the hole.

In another preferred form of the invention, the needle position adjusting part is provided at the bottom of the needle bar, and further corresponds to a needle supporting part including a hole for the needle to be inserted, to hold the needle at an eccentric position from the axis of the needle bar.

In the sewing machine with multiple needles, the relative position between the axis of the needle bar and the axis of the needle will be changed when the needle supporting part is rotated.

Therefore, in the sewing machine with multiple needles, the positional deviation between the needle and the rotary hook can be adjusted within a correctable range by rotating the needle supporting member.

In a further preferred form of the invention, a plurality of plates are each provided with a hole for each needle bar at least at the box. The holes are arranged in a horizontal line with the same interval as the needle bars, and provide for a pin that can be inserted into a hole in one of the plates. The plates can be individually moved from side to side for adjusting the respective positions.

In the sewing machine with multiple needles, the needle supporting part is rotated to adjust the relative position between the needle and the rotary hook in the back and forth direction, and then a plate corresponding to the needle is moved right or left to correct the resultant right and left positional deviation.

In this form of the invention, the needle supporting part may be combined with not only what is rotated but also with what adjusts the back and forth position of the needle. Otherwise, the needle supporting part may be rotated to adjust the relative position between the needle and the rotary hook in the back and forth direction, and then the needle bar guide may be moved right or left to correct the resultant right and left positional deviation. Therefore, according to the sewing machine with multiple needles, the positional deviation occurring in the right and left direction can be adjusted.

According to the sewing machine with multiple needles described above, the relative position between the needle and the rotary hook can be adjusted at the needle position adjusting part, however, the positional deviation may occur because of the deviation of the position of the box, in addition to machining accuracy of the needle bar driving part and the assembly accuracy of the needle bar.

In view of the above, in another preferred form of the invention, the sewing machine with multiple needles of the invention further comprises a box position adjusting part that adjusts the back and forth position of the box in relation to the body frame. When the box is out of place in the back and forth direction, it can be adjusted at the box adjusting part. If the relative position between each needle and the rotary hook is not appropriate after the position of the box is adjusted, the needle position adjusting part may be used. When the positional deviation in the back and forth direction common to all needles is adjusted in advance using the box position adjusting part, adjustment at the needle position adjusting part can be minimized.

In a further preferred form of the invention, the box position adjusting part comprises a shaft that passes through the body frame from the right to the left, and a connecting part at each end of the shaft, where the back and forth position of the box is adjusted. Therefore, according to the sewing machine with multiple needles, the position of the box can be adjusted at each end of the shaft, and even when the box is out of position around the vertical axis, its position can be adjusted.

BRIEF DESCRIPTION OF THE DRAWINGS

The invention will be described in greater detail with reference to preferred embodiments thereof and the accompanying drawings wherein:

FIG. 5(*b*) is a bottom view of the needle bar 3; and

DETAILED DESCRIPTION OF PREFERRED EMBODIMENTS

One preferred embodiment of the invention will be described in detail with reference to the accompanying drawings.

Figure 1:
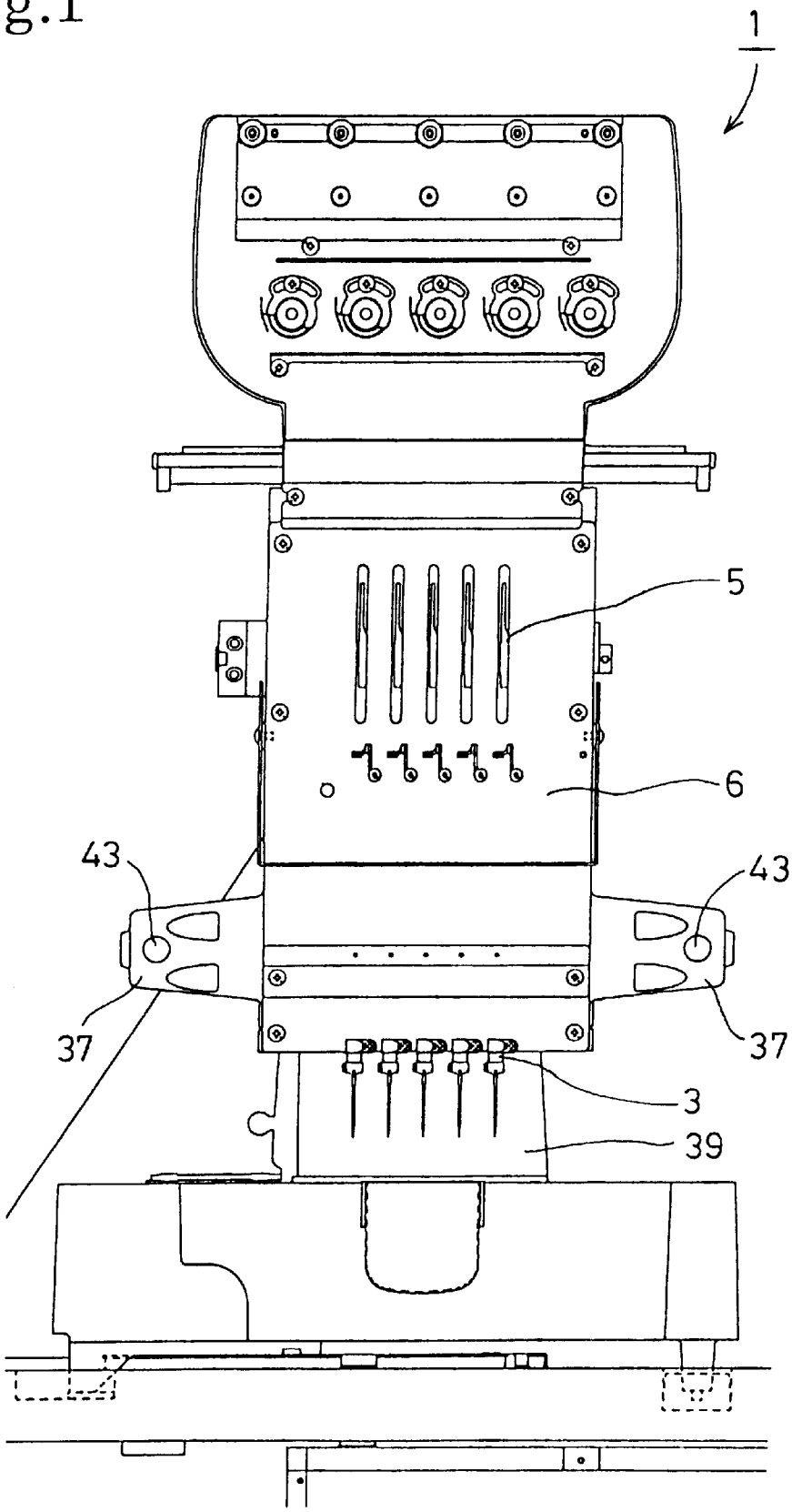
FIG. 1 is a front view of an embodiment of the embroidery machine with multiple needles 1.

FIG. 1 shows an embroidery machine with multiple needles 1 to which the invention is applied as viewed from the front. The embroidery machine with multiple needles 1 comprises five needle bars 3 and corresponding five needle thread take-ups 5 which are arranged in a line in front of the machine 1. When a box 6, including the needle bars 3 and needle thread take-ups 5, is moved right or left, a needle bar 3 and a corresponding needle thread take-up 5 are selected and embroidering is performed with a thread passed through the selected needle thread take-up 5 and needle bar 3. A support member 37, which protrudes from each side of a lower side of the box 6 supports the box 6 to a body frame 39.

Figure 2:
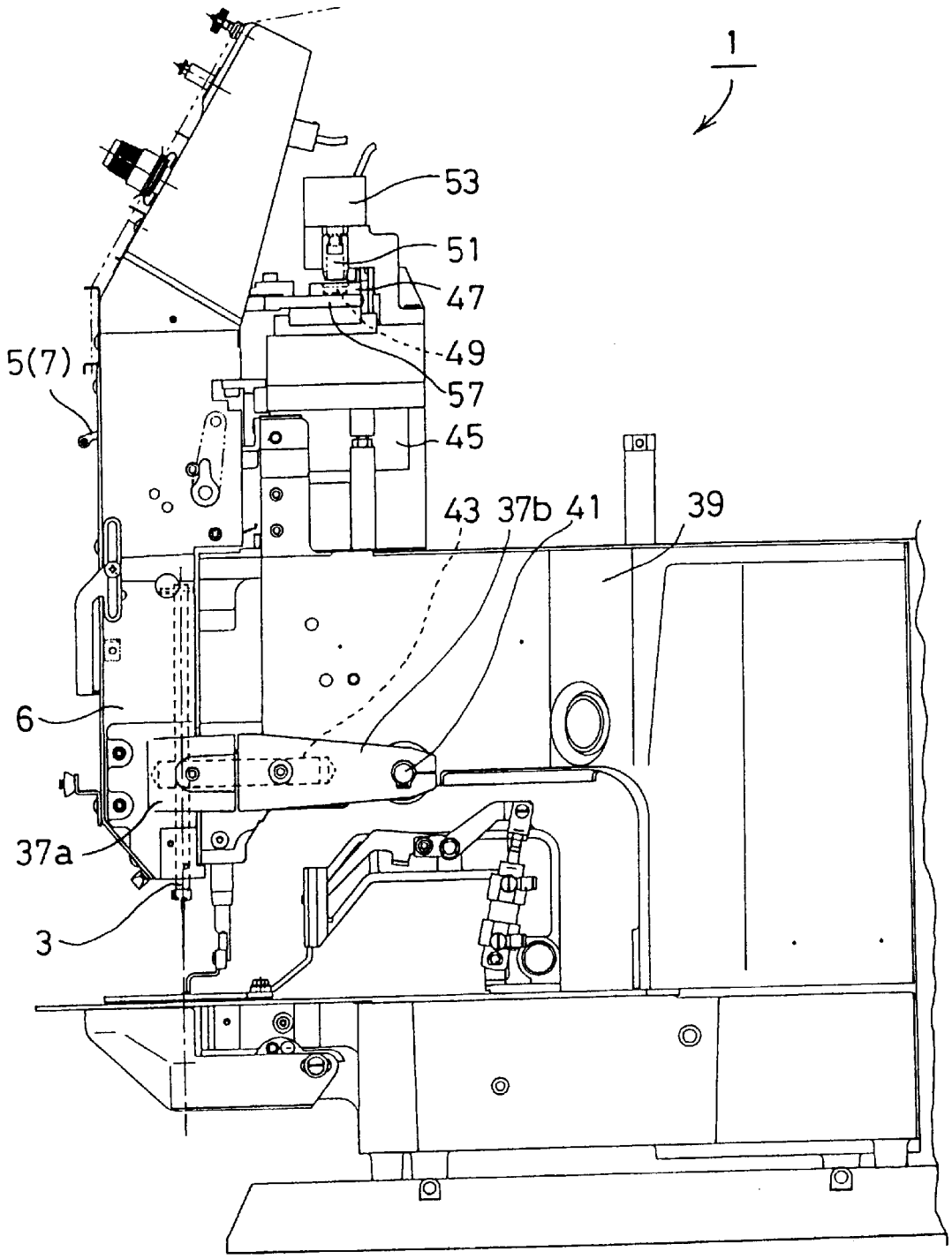
FIG. 2 is a side elevation of the sewing machine.

FIG. 2 is a right side of the embroidery machine with multiple needles 1, omitting a rear part of the machine 1. As shown, the support member 37 extends from the box 6 backward, and is separated into support 37*a* and support 37*b*. The support 37*b* fixes a right and left shaft 41 that passes through the body frame 39 abeam. Each support member 37 has a back and forth shaft 43 built-in.

A motor 45 is a power source to move the box 6 to the right and left, and corresponds to a box driving part of the invention. A plate 47 is used to determine the position of the box 6 which is moved by the motor 45. A pin 51 is inserted into a hole 49 in the plate 47, to determine the right and left position of the box 6. That is, the pin 51 corresponds to a pin of the invention. A pneumatic cylinder 53 is used to raise the pin 51.

Figure 3:
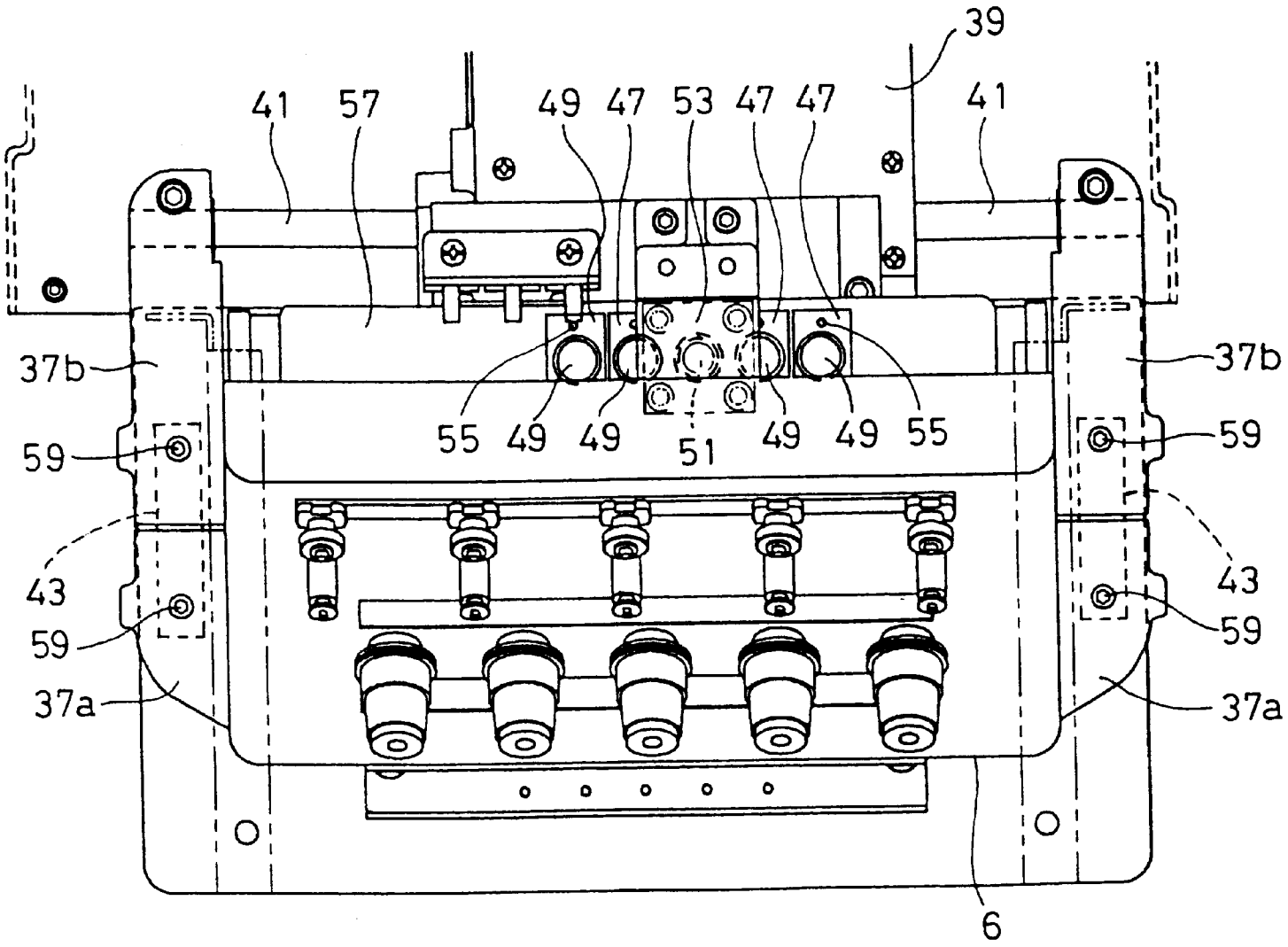
FIG. 3 is a plan view of the box of the sewing machine.

FIG. 3 is a plan view of the box 6. As shown, there are five plates 47 (one of them is hidden under the pneumatic cylinder 53), which are fixed to a base plate 57 using the screws 55. When a screw 55 is loosened, a plate 47 can be moved approx. 0.2 mm right or left. The screws 59 are used to fix the back and forth shafts 43 and supports 37*a* and 37 of both sides. When the screws 59 are loosened, the orientation of the box 6 can be adjusted relative to the right and left shaft 41 by moving toward or away from the right and left shaft 41. The adjustment may be made at one support member 37 or both support members 37 to obtain different orientations of the box 6. The back and forth shafts 43 and screws 59 correspond to a connecting part of the invention, and the right and left shaft 41 corresponds to a shaft of the invention.

Figure 4:
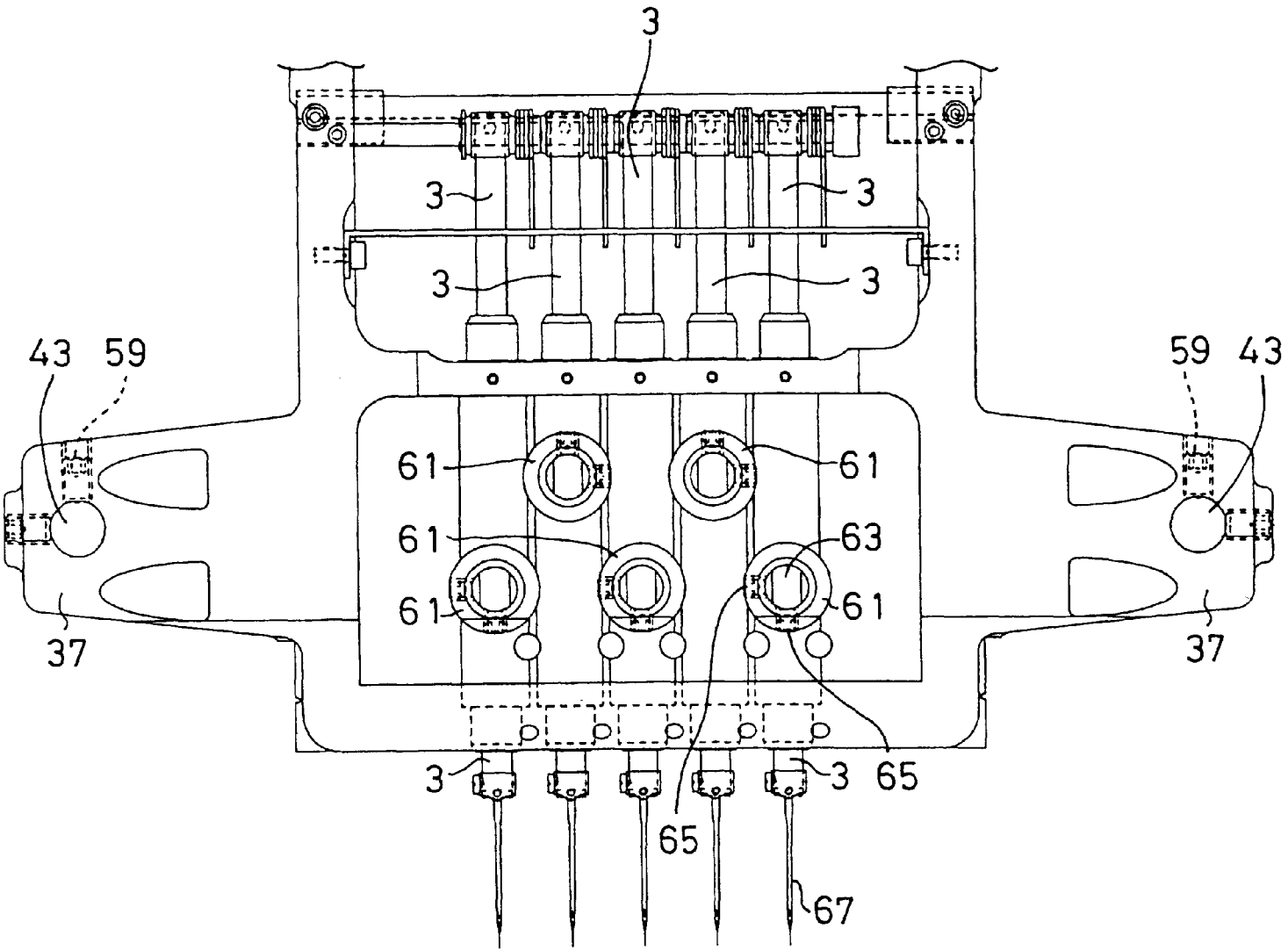
FIG. 4 shows an aspect of the housing of the box.

A mechanism for adjusting the position of the needle bar 3 (hereinafter referred to as a needle bar adjusting part) will now be described. FIG. 4 shows the box 6 with the cover or housing removed from the state shown in FIG. 1. The upper part in which thread take-ups 5 are arranged is not shown. Inside the box 6, as shown in the figure, is a boss 61 corresponding to each needle bar 3, each boss 61 receiving a projection 63, extending from needle bar guide 71, passing through a hole formed in the boss 61 and the projection 63 fixed inside the boss 61 using a screw 65. When the screw 65 is loosened to rotate the projection 63 or move it back and forth, the angular orientation relative to the boss 61 around the center axis and the back and forth position of the projection 63 relative to the boss 61 can be adjusted.

Figures 5A, 5B:
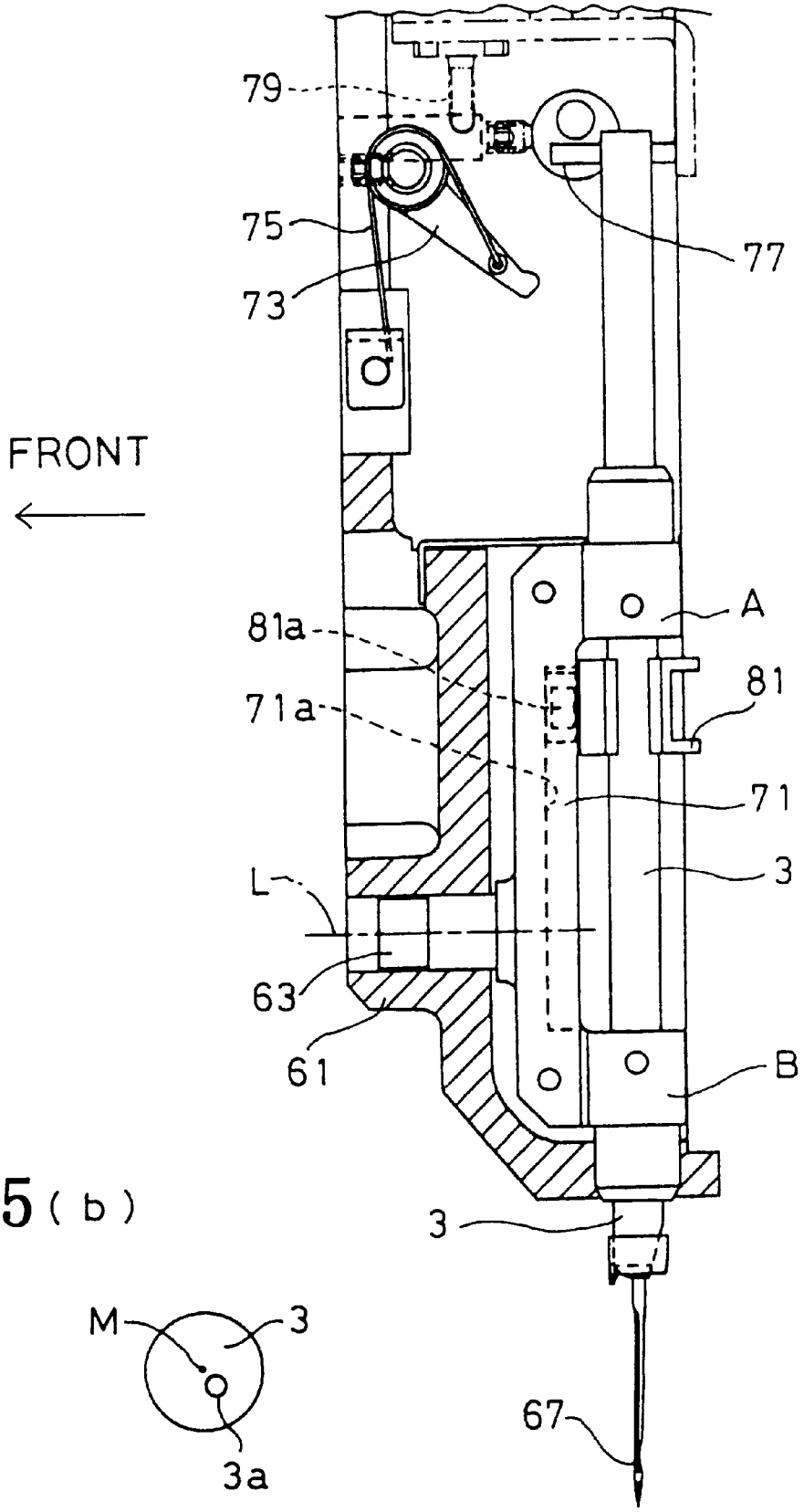
FIG. 5(*a*) is a side elevation of the needle bar adjusting part.

FIG. 5(*a*) is a side elevation of the needle bar adjusting part. The projection 63 is incorporated with a needle bar guide 71 which is in the shape of letter "C" as shown in the figure. The needle bar guide 71 enables the needle bar 3 to rotate and move vertically by inserting the needle bar 3 into the through holes formed in upper and lower parts A and B of the needle bar guide 71. Therefore, when the projection 63 is turned in the boss 61, the needle bar guide 71 is also turned and the end of the needle 67 is oscillated relative to an axis L. When the projection 63 is moved back and forth in the boss 61, the end of the needle 67 is moved in the same manner. In between upper and lower parts A and B of the needle bar guide 71 is a needle bar clamp 81 that receives the transmission of the needle bar driving part. The needle bar clamp 81 is fixed to the needle bar 3 using a screw (not shown). A protrusion 81*a* is provided in the needle bar clamp 81, and a long groove 71 a, extending vertically, in which the protrusion 81*a* is fitted, is formed in the needle bar guide 71.

Therefore, when the projection 63 is fixed, fixing the needle bar guide 71, the needle bar clamp 81 is held by the protrusion 81*a* engaged in the long groove 71*a* so it cannot rotate. Further, when the needle bar 3 is fixed to the needle bar clamp 81 by the screw, the needle bar 3 cannot rotate. At the bottom of the needle bar 3, there is a hole 3*a* in which the needle 67 is inserted and supported in an eccentric position approx. 0.5 mm away from the center M, as shown in FIG. 5(*b*). The bottom of the needle bar 3 corresponds to a needle support part of the invention. When the screw of the needle bar clamp 81 is loosened, the needle bar 3 can be rotated, and the position of the end of the needle 67 can be adjusted. At that time, the needle 67 rotates with the needle bar 3. After adjusting the position of the end of the needle 67 by turning the needle bar 3, the needle 67 should be adjusted so that the needle hole substantially faces the front.

An arm 73 serves to position the needle bar 3 to the top dead point of its vertical movement. The arm 73 makes contact with the pin 77 that is attached to the top of the needle bar 3 by force of the spring 75, causing the needle bar 3 to be lifted up to the top dead point. When the needle bar 3 is moved up and down, the pneumatic cylinder, not shown, lowers the pin 79, lowering the end of the arm 73. When the needle bar 3 is in a standby position, the pin 79 rises (as shown in the figure), and the needle bar 3 is moved to the top dead point.

Figure 6:
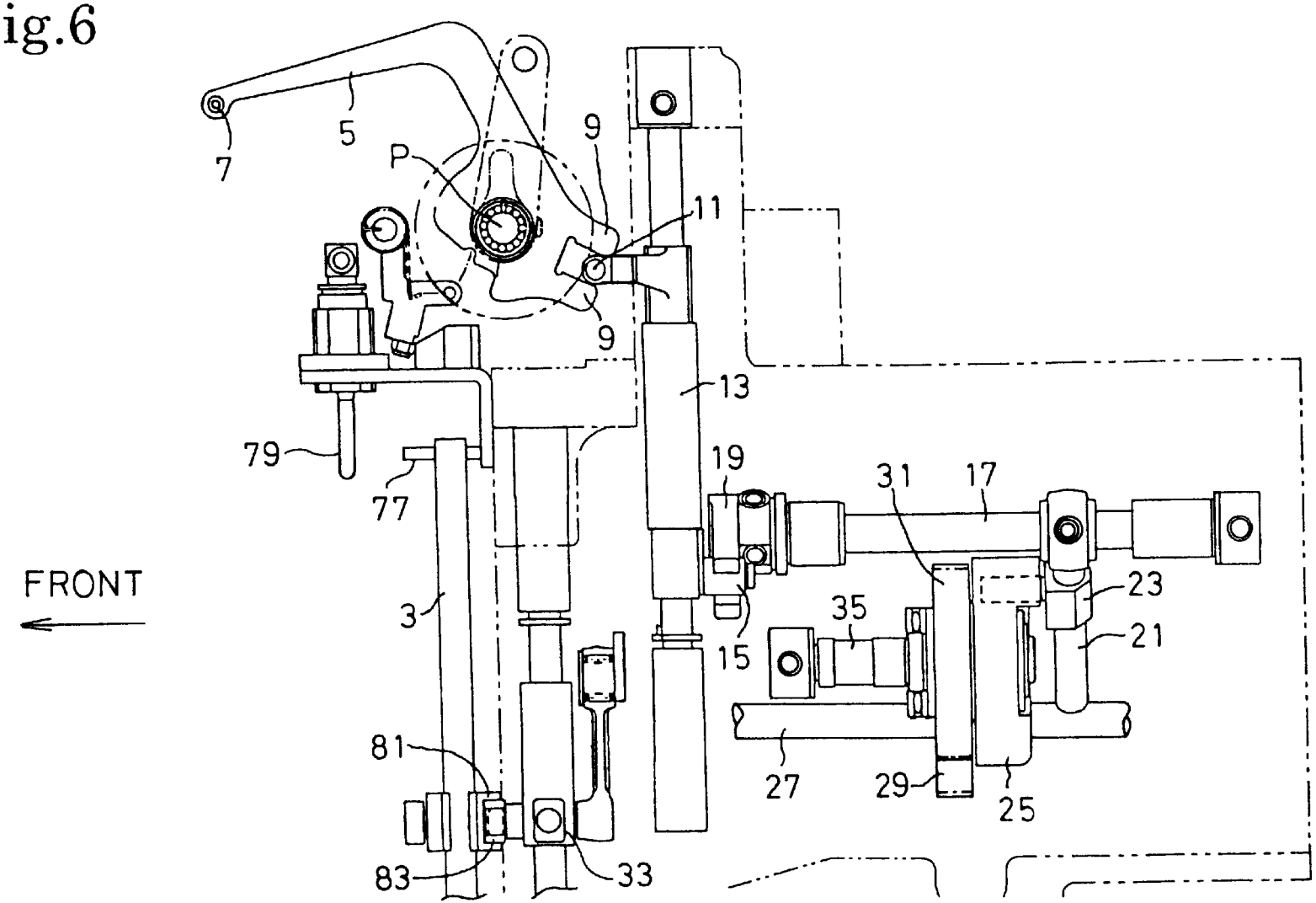
FIG. 6 is a side elevation of the thread take-up mechanism of the sewing machine.

FIG. 6 shows a thread take-up driving part which is inside the embroidery machine with multiple needles 1 when FIG. 1 is viewed from the right (the needle bar guide 71 shown in FIG. 5(*a*) is left out). The thread take-up 5 can rotate around an axis at point P. The end 7 and a second fork part 9 are nearly symmetrically placed in relation to point P. A first hollow cylinder 11 that is caught in the second fork part 9 is moved up and down, and the thread take-up 5 oscillates on point P. The first hollow cylinder 11 extends toward the rear in the figure, and its circumference fits into the second forked part 9 with a slight space. When a switch is made to another thread take-up 5 the needle bar 3 is stopped at the top dead point, the box 6 is moved, and a second fork part 9 of another thread take-up 5 engages the first hollow cylinder 11.

The first hollow cylinder 11 is fixed to the thread take-up driving rod 13, and is driven with a second hollow cylinder 15, that is attached to a lower part of thread take-up driving rod 13, (shown on the right in the figure) is moved up and down by the rocking shaft 17. The first fork part 19 that is formed at the front end of the rocking shaft 17 (shown on the left in the figure), catches the second hollow cylinder 15. When the rocking shaft 17 is moved, the second hollow cylinder 15, the thread take-up driving rod 13, and the first hollow cylinder 11 are moved up and down, and the thread take-up 5 is oscillated.

A mechanism that moves the rocking shaft 17 comprises the arm 21, the sliding member 23, the crank 25, and the upper shaft 27. The upper shaft 27 is rotated at a designated speed by a motor (not shown), and its motion is transmitted to the crank 25 via the gears 29 and 31. The sliding member 23 is fitted in the crank 25 so that it can be rotated in parallel with the upper shaft 27. The arm 21 goes through the sliding member 23. The arm 21 is provided vertically in the rocking shaft 17. When the upper shaft 27 is rotated at a designated speed with this condition, the rocking shaft 17 is oscillated.

The engaging part 83 provided in the side of the needle bar driving rod 33 is fixed in the needle bar clamp 8 1. When the upper shaft 27 is rotated, the needle bar driving rod 33 is moved up and down via the crank mechanism (not shown) causing the needle bar 3 to move.

According to the embroidery machine with multiple needles 1 arranged as mentioned above, since each needle bar 3 has a needle position adjusting mechanism, it is possible to adjust for the positional deviation for each needle bar 3, which occurs because of a difference in machining and assembly accuracy. When the projection 63 is rotated in the boss 61, the needle bar 3 is oscillated about the axis L (referring to FIG. 5), and the end of the needle 67 is moved right and left. By moving the projection 63 along the straight line L, the end of the needle 67 can be moved back and forth.

It is also possible to adjust the position of the end of the needle 67 by rotating the needle bar 3. In this case, however, it is impossible to adjust the right and left position and the back and forth position of the end of the needle 67 separately. After the back and forth position of the needle 67 is adjusted, the right and left position should be adjusted by changing the position of the plate 47 right and left.

When the box 6 is out of position in the direction of the rotation around a vertical axis or in the back and forth direction, the positional deviation of the box can be corrected by loosening the screws 59 and moving the box 6 toward and away from the right and left shaft 41.

By implementing the above-mentioned adjustments in accordance with the degree of positional deviation, the relative position between the end of each needle bar 3 and the rotary hook can be adjusted.

The above embodiment is described with respect to the embroidery machine with multiple needles 1 to which the invention is applied. The invention is not limited to the example, but is applicable to various cases.

For example, the invention may be applied to a sewing machine with multiple needles, not an embroidery machine. A sewing machine with two to four or six or more needle bars 3 may use the invention.

In the above-mentioned embodiment, the position of the needle 67 is adjusted by rotating the needle bar 3. Instead, a needle holding member, that can be rotated, may be added separately to the end of the needle bar 3 and be rotated relative to the needle bar to adjust the position of the needle 67.

When the needle bar 3 is adjusted only in the right and left directions, the needle bar guide 71 is rotated around the axis L. The needle bar guide 71 may be replaced by the boss 61 so that the needle bar 3 can be slid to the right and left. It is not necessary to provide for all mechanisms mentioned in the embodiments. It may be possible to use necessary mechanisms together or separately as required. That is, if the machine has the five plates 47 and a pin 51 that can adjust the position of the needle, no mechanism that makes the needle bar guide 71 rotate around the straight line L is needed. The shape of the projection 63 and the shape of the hole in the boss 61 may be changed to a square, from the cylindrical shape described above, and the support member 37 may be moved only back and forth.

What is claimed is:

1. A sewing machine with multiple needles, comprising:

a plurality of needle bars that are arranged in a horizontal line;

a box holding the needle bars;

a needle bar driving part that allows each needle bar of the plurality of needle bars to move up and down;

a body frame including the needle bar driving part;

a box driving part that moves the box right and left relative to the body frame, to transmit the driving force of the needle bar driving part only to a desired needle bar; and a needle position adjusting part provided in each needle bar, wherein a relative position between a needle that is attached to the end of the needle bar and a rotary hook that receives both the needle, and an upper thread passed through the needle, can be adjusted.

2. The sewing machine with multiple needles according to claim 1, wherein the needle position adjusting part comprises a needle bar guide associated with each needle bar that holds the needle bar vertically, the needle bar guide being provided at the box so as to be adjustable in a horizontal direction.

3. The sewing machine with multiple needles according to claim 2, wherein the needle bar guide is provided at the box so as to be individually adjustable in a right and left direction.

4. The sewing machine with multiple needles according to claim 2, wherein the needle bar guide is provided at the box so as to be individually adjustable in a back and forth direction.

5. The sewing machine with multiple needles according to claim 2, wherein the needle bar guide is in the shape of the letter "c" and holds the needle bar vertically by passing it through upper and lower holes of the needle bar guide, the sewing machine further comprising:

a projection that is horizontally provided in an opposite side of the part of the needle bar guide through which the needle bar passes; and a corresponding hole provided at the box along the back and forth direction so that the projection fits therein, wherein the needle bar guide is adjustable relative to the box by changing a seated position and the rotation angle of the projection relative to the corresponding hole.

6. The sewing machine with multiple needles according to claim 1, wherein the needle position adjusting part comprises a needle supporting part provided at the lower end of the needle bar, the needle supporting part defining a needle inserting hole which holds the needle eccentrically positioned relative to the axis of the needle bar.

7. The sewing machine with multiple needles according to claim 2, wherein the needle position adjusting part is provided at the lower end of the needle bar, and corresponds to a needle supporting part comprising a hole into which the needle is inserted so that it is eccentrically positioned relative to the axis of the needle bar.

8. The sewing machine with multiple needles according to claim 1, wherein the needle position adjusting part comprises:

a plurality of plates, each plate with a hole, are provided at the box, in at least the same number as the needle bars, the plurality of plates arranged in a horizontal line with the same interval as the needle bars; and a pin that is provided at the box, the pin engageable with and retractable from with a hole in one of the plates, wherein each plate of the plurality of plates can be separately moved from side to side for adjusting the respective position.

9. The sewing machine with multiple needles according to claim 2, wherein the needle position adjusting part compresses:

a plurality of plates, each plate with a hole, are provided at the box, in at least the same number as the needle bars, the plurality of plates arranged in a horizontal line with the same interval as the needle bars; and a pin that is provided at the box, the pin engageable with and retractable from a hole in one of the plates, wherein each plate of the plurality of plates can be separately moved from side to side for adjusting the respective position.

10. The sewing machine with multiple needles according to claim 6, wherein the needle position adjusting part comprises:

a plurality of plates, each plate with a hole, are provided at the box, in at least the same number as the needle, the plurality of plates arranged in a horizontal line with the same interval as the needle bars; and a pin that is provided at the box, the pin engageable with and retractable from a hole in one of the plates, wherein each plate of the plurality of plates can be separately moved from side to side for adjusting the respective position.

11. The sewing machine with multiple needles according to claim 1, further comprising a box position adjusting part that adjusts a back and forth position of the box relative to the body frame.

12. The sewing machine with multiple needles according to claim 11, wherein the box position adjusting part comprises a shaft that passes through the body frame from the one side to the other, and a connecting part at each end of the shaft, both which adjust the back and forth position of the box.

13. A sewing machine, comprising:

a plurality of sewing needles, each sewing needle mounted to a needle bar;

a box housing the needle bars;

a support member on each side of the box connecting the box and the sewing machine;

engagement means for engaging a selected needle for sewing; and driving means for driving a selected needle for sewing, wherein at least one of the support member, engagement means and driving means permits adjustment of the needle position relative to a rotary hook of the sewing machine.

14. The sewing machine according to claim 13, wherein the engagement means comprises:

a pneumatic cylinder;

a pin reciprocated by the pneumatic cylinder; and a plurality of plates having a hole for receiving the pin, a plate provided for each needle bar, each plate adjustable from side to side relative to a feed direction of a material to be sewn.

15. The sewing machine according to claim 13, wherein the support member comprises:

a first support section mounted to the box;

a second support section mounted to the sewing machine;

a shaft seated in the first and second support sections; and a lock mechanism to lock the shaft in a selected position, wherein the support member allows adjustment to the plurality of needle bars in a back and forth direction parallel to a direction of feed of a material to be sewn.

16. The sewing machine according to claim 13, wherein driving means comprises:

a needle bar clamp mounted to the needle bar; and a needle bar driving rod engaging the needle bar clamp, the needle bar clamp allowing the needle bar to rotate when in a loosened state, the needle bar having a needle hole eccentrically positioned relative to an axis of the needle bar whereby rotating the needle bar adjusts a position of the needle.

17. The sewing machine according to claim 13, further comprising:

a needle bar guide for each needle bar of the plurality of needle bars; and an adjustment mechanism for adjusting the position of the needle bar and a needle attached thereto.

18. The sewing machine according to claim 17, wherein the adjustment mechanism comprises:

a projection extending from the needle bar guide;

a boss for each needle bar guide as a part of the box, the projection received in the boss for each needle bar guide, the projection capable of back and forth movement in the boss and rotation relative to the boss; and locking means for fixing the position of the projection in the boss.

* * * * *